United States Patent [19]

Geisinger

[11] Patent Number: 4,619,102

[45] Date of Patent: Oct. 28, 1986

[54] WRAPPER SEALING SYSTEM

[75] Inventor: Wolfgang Geisinger, Rosemere, Canada

[73] Assignee: Muller Manufacturing Ltd, Montreal, Canada

[21] Appl. No.: 665,057

[22] Filed: Oct. 26, 1984

[51] Int. Cl.[4] ..... B65B 13/02

[52] U.S. Cl. ..... 53/399; 53/441; 53/556; 53/587

[58] Field of Search ..... 53/211, 399, 441, 556, 53/587

[56] References Cited

U.S. PATENT DOCUMENTS

| | | | |
|---|---|---|---|
| 3,003,297 | 10/1961 | Broadhead et al. | 53/135 |
| 4,216,640 | 8/1980 | Kaufman | 53/587 |
| 4,235,062 | 11/1980 | Lancaster et al. | 53/399 |
| 4,300,326 | 11/1981 | Stackhouse | 53/587 |
| 4,432,185 | 2/1984 | Geisinger | 53/587 |

FOREIGN PATENT DOCUMENTS

| | | | |
|---|---|---|---|
| 2493802 | 11/1980 | France | 53/587 |

*Primary Examiner*—John Sipos
*Assistant Examiner*—Donald R. Studebaker
*Attorney, Agent, or Firm*—C. A. Rowley

[57] ABSTRACT

A method and apparatus for sealing a film wrapping. A charge or load wherein an anvil is first brought into contact with the charge and then the wrapping operation commences. After the film is wrapped sufficiently to hold itself to the charge, a clamp holding the end of the film is released and is then moved to a retracted position where it stays until the wrapping is almost completed. When a first lap of film has been wrapped over the anvil, a jaw of the clamp is moved into position adjacent the anvil and a second lap of film is wound over the anvil and jaw. Next the heat sealer is operated to cooperate with the anvil and seal the two laps together and a second jaw of the clamp is moved to operative position to clamp the second or last lap of film which is then cut between the clamp and the heat seal so formed.

10 Claims, 18 Drawing Figures

WRAPPER SEALING SYSTEM

FIELD OF THE INVENTION

The present invention relates to a system of securing a wrapper around a charge, more particularly the present invention relates to a system of heat sealing a film wrapper and retaining the severed end in position for a following wrapping operation.

BACKGROUND OF THE PRESENT INVENTION

There are many techniques of wrapping pallets with plastic film and plastic netting. Generally when the wrapping operation is completed the wrapper is somehow secured to underlying layers of the wrapping film by any suitable means. In some cases the securing is by roping the film and stapling the two roped ends together, for example as described in U.S. Pat. No. 4,418,510 issued Dec. 6, 1983 to Lancaster or as taught in U.S. Pat. No. 4,432,185 issued Feb. 21, 1984 to Geisinger.

In the later patent an anvil similar to that disclosed herein was used to determine the position of the charge to permit the other operating mechanisms to be brought into proper position for clamping, securing (stapling) and cutting the film. The later elements were mounted on a separate carriage which moved into a specific relationship with the anvil by sensing the position of the anvil and thus of the side of the charge to be wrapped.

The wrapping and sealing systems generally did not employ heat sealing and were relatively complex.

BRIEF DESCRIPTION OF THE INVENTION

It is an object of the present invention to provide a simplified sealing and holding system for film wrapping.

It is a further object of the present invention to provide a system for heat sealing a wrapper on a charge.

Broadly the present invention relates to a system of wrapping a charge comprising, holding an end of a film in a clamp, positioning an anvil against a charge while simultaneously moving said clamp into position, commencing wrapping of said film around said charge by relatively rotating said charge and a source of said film, releasing a first jaw of said clamp to free said film when said film is retained on said charge, retracting a cooperating jaw of said clamp to retracted position, completing the wrapping of said charge with said film and wrapping a first lap of film over said anvil, moving said cooperating jaw to its initial position and in overlying relation to said first lap, wrapping a second lap of said film over said anvil and over said cooperating jaw, moving said first jaw into clamping relation with said cooperating jaw to clamp said second lap therebetween and securing said first and second laps together over said anvil.

Preferably said securing will be accomplished by moving a heat sealing platen into cooperating relationship with said anvil to form a heat seal between said platen and said anvil.

The film is cut off between the heat seal and the clamp by a severing means on said clamp.

After the heat seal is produced the platen is retracted and the anvil lowered to clear the film wrapping the charge and the anvil and clamp are retracted to an initial position to await the next charge.

Preferably the heat sealing will be formed by a plurality of discrete pins so that instead of a single heat sealed band a plurality of discrete seals are formed which may be laid out in any suitable pattern but because of the spaces between the seals the likelihood of tearing of the film along the seal is greatly reduced.

BRIEF DESCRIPTION OF THE DRAWINGS

Further features, objects and advantages will be evident from the following detailed description of the preferred embodiment of the present invention taken in conjunction with the accompanying drawings in which.

DESCRIPTION OF THE PREFERRED EMBODIMENTS

Figure 1:
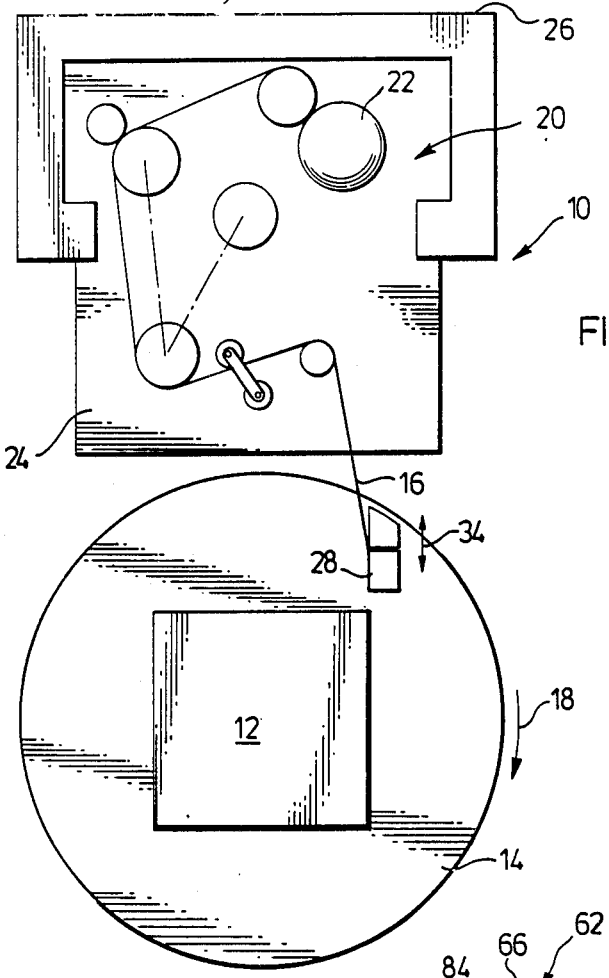
FIG. 1 is a schematic plan view of a wrapper incorporating the present invention.

As shown in FIG. 1, the invention may be applied to a conventional pallet wrapper 10 wherein the charge 12 is placed on a turntable 14 and a plastic film 16 is wrapped therearound by rotating the turntable 14 as indicated by the arrow 18.

The wrapping film 16 may be prestretched using a conventional prestretching mechanism 20 as described for example in the said Lancaster patent. The film is unwound from a roll 22 and fed, if desired, through the prestretch mechanism 20 and then wrapped around the charge 12 by the relative rotation of the charge and the supply roll 22. Generally the wrapper is helically wound around the charge which requires that the platform 24 on which the supply roll 22 and prestretch mechanism 20 are mounted be elevated on column 26 to the top of the charge and then lowered as the charge is rotated. The helix angle on the upward movement of the platform may be larger than on the downward movement. The helix formed as the platform 24 is moved downward is usually correlated with the width of the film so adjacent portions of the helix overlap.

The main mechanism of the present invention is mounted on and rotated with the turntable 14 and is mounted within a cavity 28 formed in the turntable.

Figure 2:
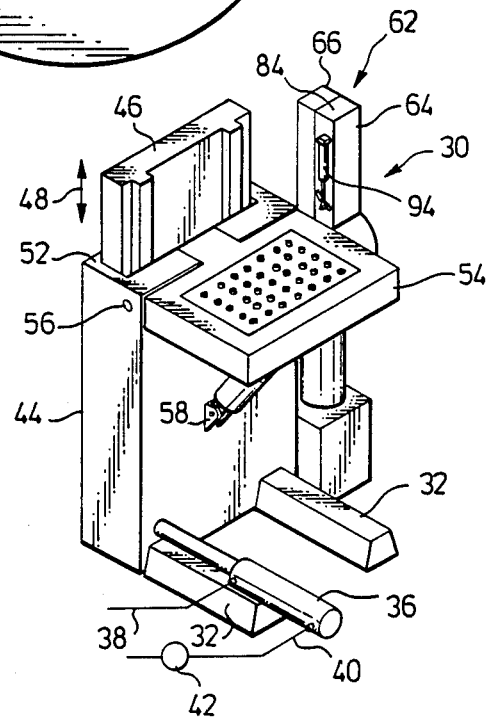
FIG. 2 is a schematic isometric view of the anvil clamping and sealing mechanism of the invention.

The clamping and sealing mechanism of the present invention is generally indicated at 30 in FIG. 2 and is mounted for movement along the cavity 28 on a pair of spaced tracks 32. These tracks extend substantially the full length of the cavity 28 so that the mechanism 30 may move as indicated by the arrow 34 of FIG. 1. The mechanism 30 may be moved along the tracks 32 by any suitable means such as the piston and cylinder 36 to which (assuming a pneumatic system) air will be fed via lines 38 or 40.

The line 40 for advancing the mechanism 30 will have a limiting device 42 therein to limit the pressure that will be applied so that the advance of mechanism 30 is stopped when the charge 12 is contacted and the mechanisms are held in position by the pressure set by the pressure limiting valve 42 as will be described hereinbelow.

Figure 3:
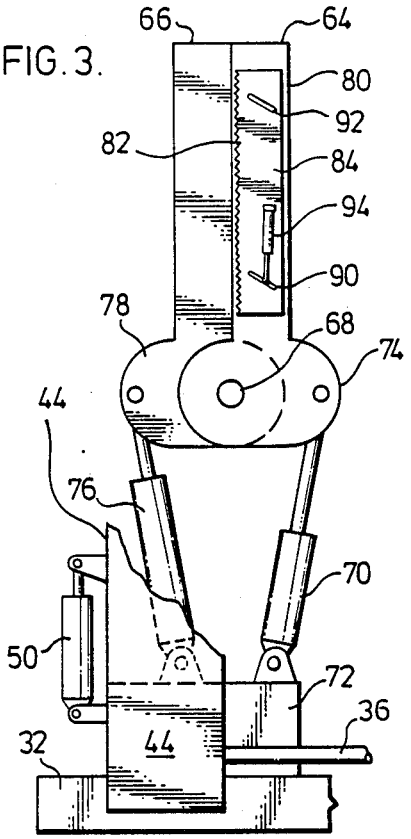
FIG. 3 is a side elevation of the mechanism of FIG. 2 with parts broken away illustrating the clamp and activating elements thereof.
Figure 4:
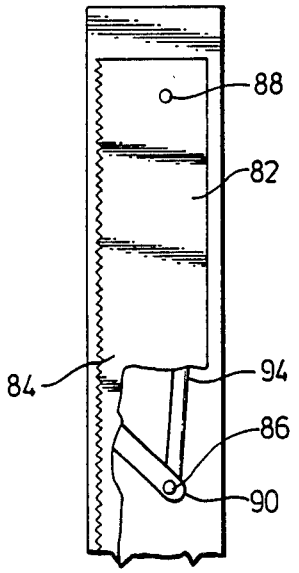
FIG. 4 is an illustration of one form of cut of mechanism mounted on one of the jaws of the clamp.

The mechanism 30 comprises a platform 44 which is mounted on the tracks 32 and moved via the piston and cylinder 36. This platform slidably mounts an anvil 46 which is movable as indicated by arrow 48 between the elevated position shown in FIG. 2 and the retracted position shown in FIG. 3 via a piston and cylinder 50. The anvil 46 is mounted in a suitable slide 52 formed on the platform 44. A heat sealing platen 54 is pivotally mounted on the platform 44 on pivot pin 56. The platen 54 is pivoted between its open position shown in FIG. 2 to its closed position shown for example in FIGS. 15, 16, 17, or 18 by a suitable piston and cylinder 58 (see FIG. 2). In its closed position the platen 54 cooperates with the anvil 46 to clamp the film layers therebetween and heat seal the layers together as will be described hereinbelow.

Figure 5:
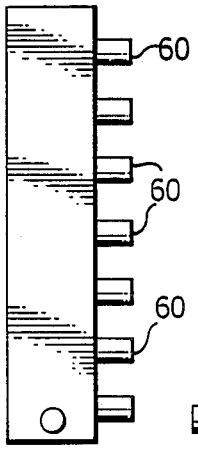
FIG. 5 is a side elevation of the heat sealing platen of the invention.
Figure 6:
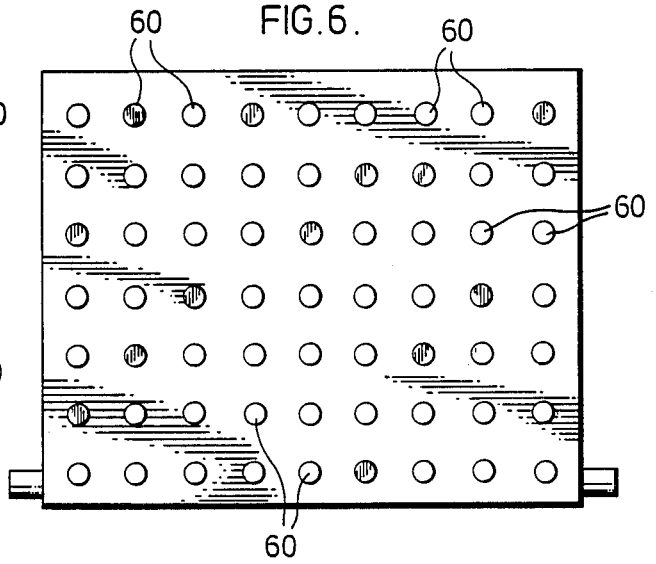
FIG. 6 is a view of the platen of FIG. 5 looking directly at the heat sealing face.

Preferably the heat sealer of the present invention will be formed by a plurality of raised or projecting pins 60 as shown in FIGS. 5 and 6. These pins produce discrete sealed areas to aid in preventing tearing along the heat seal. The projections 60 may be arranged in a pattern for example to spell the name of the manufacturer of the goods being packaged to provide an added feature. As can be seen, the pattern illustrated shows a letter A.

The mechanism 30 also carries a clamp 62 which is formed by a first jaw 64 and a cooperating jaw 66 pivotably mounted on a column pivot pin 68 at one side of the platform 44.

Each of the jaws 64 and 66 has its own activating mechanism whereby it is moved from one position to another. The jaw 64 has a piston and cylinder 70 extending from a block 72 mounted on the side of the platform 44 and pivotably connected to a lobe 74 on the jaw 64. The cooperating jaw 66 has a similar piston and cylinder 76 extending from the block 72 and pivotably connected to a lobe 78 on the jaw 66.

Mounted on the side of the jaw 64 adjacent the platform 44 is a cut off mechanism 80, which is formed by a blade 82 received within a housing 84 on the side of the jaw 64. Pins 86 and 88 extend through sloped slots 90 and 92 in the wall of the housing 84. A suitable actuating mechanism such as a solenoid or pneumatic piston 94 is connected to the pin 86 to slide the pins 86 and 88 along their slots 90 and 92 to move the blade 82 between extended operating cutting position and an inactive retracted position.

Having described the elements of the invention, the operation will now be described in relation to FIGS. 7 to 11 inclusive.

Figure 7:
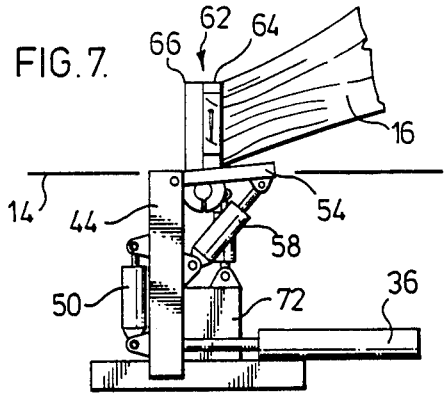
FIGS. 7 to 18 illustrates the sequence of operation of the various elements of the present invention.

At the beginning the film 16 is held in the clamp 62 preferably in a roped (narrowed) condition as will be described hereinbelow and with the clamp in a closed vertical position as shown in FIG. 7.

Figure 8:
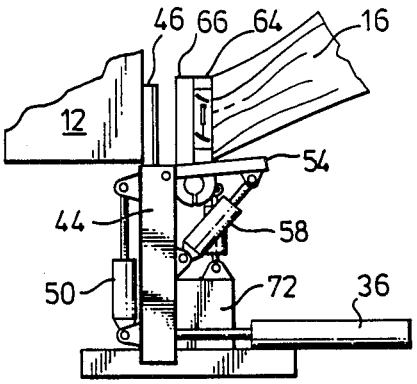

A charge 12 is moved onto the table 14, the anvil moved to operative position extending upward from the platform 44 and the platform 44 is moved toward the charge 12 until the anvil contacts same and the pressure set by the valve 42 attained thereby to hold the anvil 46 against the charge 12 as illustrated in FIG. 8.

The turntable 14 is then rotated to rotate the charge 12 and film is discharged from the prestretch mechanism 20 to commence wrapping of the charge 12 in the conventional manner. The first jaw 64 of the clamp is moved to open or inactive position as shown in FIG. 9 when sufficient film has been wrapped around the charge to hold the film to the charge thereby to release the end of the film 16 which, as above indicated, is partially wrapped around the charge 12.

Figure 9:
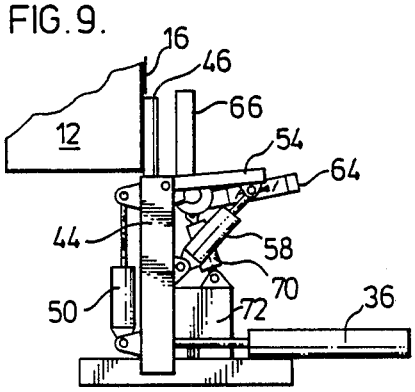
Figure 10:
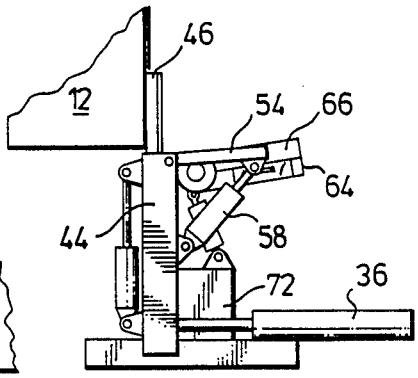

Next the cooperating jaw 66 of the clamp 62 is moved to inoperative position via its piston and cylinder 76 as shown in FIG. 9 and the wrapping of the charge continued by elevating the platform 24 to move the film to the top of the charge 12 and then return down to the bottom.

Figure 11:
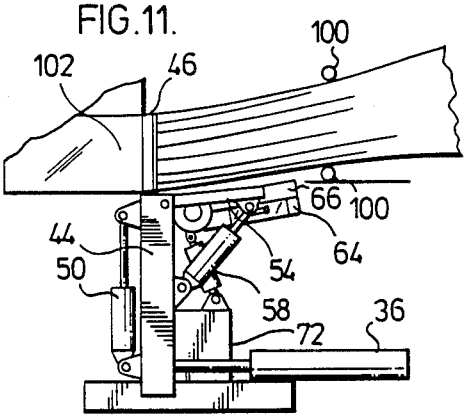
Figure 12:
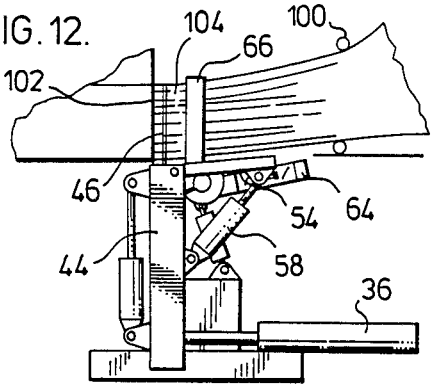
Figure 13:
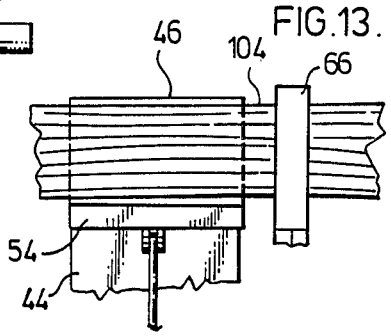
Figure 14:
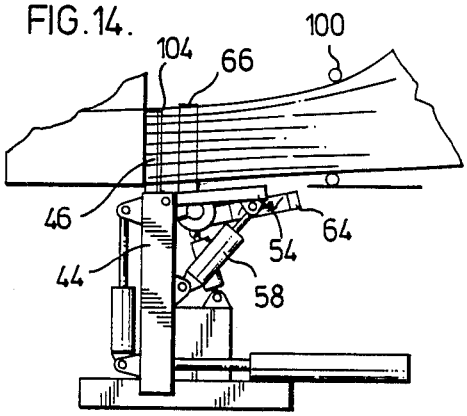
Figure 15:
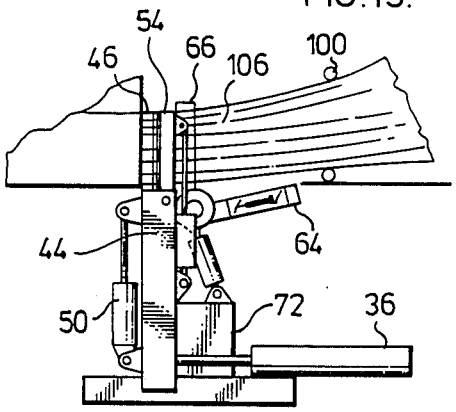
Figure 16:
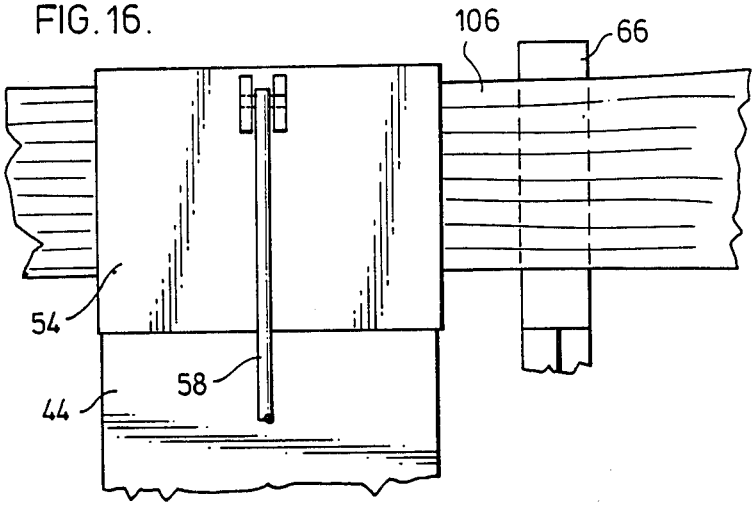

As the bottom is approached a conventional roping means, two parts of which are indicated at 100 in FIGS. 11, 12, 14, 15 and 17, is operated to reduce the width of the web 16 and form a rope layer 102 which is layed as a lap 104 over the anvil 46 as shown in FIG. 11. At this time the cooperating jaw 66 is moved back to elevated active position as shown in FIGS. 12 and 13. A second or last lap 106 of roped material is wrapped around the charge 12 and over both the anvil 46 and the cooperating jaw 66 to complete the winding of film around the charge.

Next the heat seal plates 54 may be moved to sealing position to cooperate with the anvil 46 and effect a heat seal and the jaw 64 moved to clamping position. Alternatively the jaw 64 may first be moved to clamping position and then the heat sealing platen 54 operates or both the jaw 64 and platen 54 may be operated simultaneously. In any event the two laps 104 and 106 are heat sealed together in the manner shown in FIGS. 14 to 17 and the lap 106 is held in the clamp 62.

Figure 18:
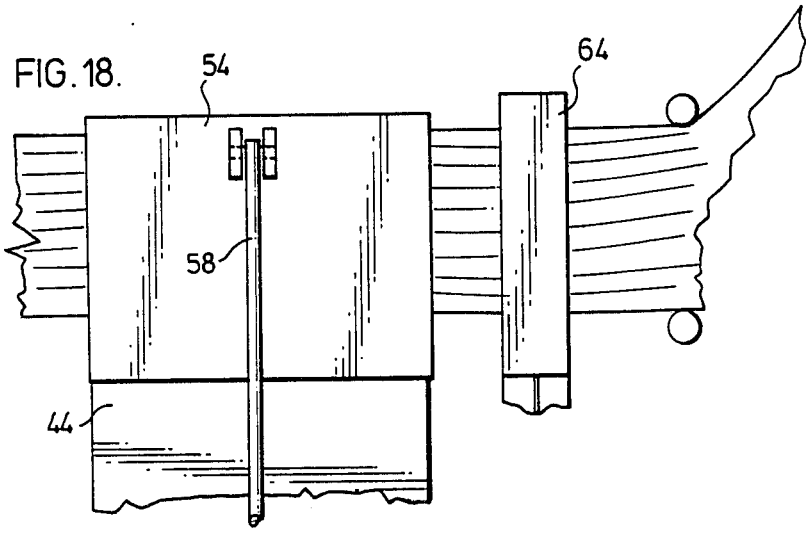
Figure 17:
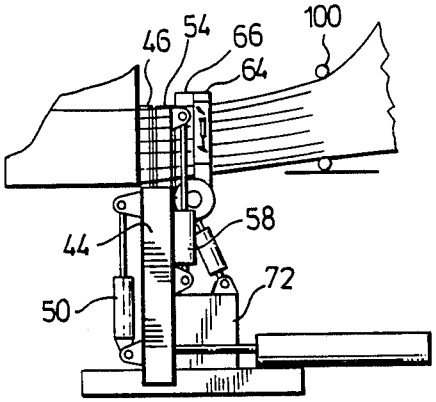

Next the severing mechanism 80 is activated and the solenoid or piston 92 moves the blade 82 to extended position and severes the film 16 as shown in FIG. 18 to complete the wrapping operation and leave the roped end of the film 16 held between the jaws 66 and 64 in position to repeat the operation as shown in FIG. 7. The anvil 46 is then drawn down to retracted position into the platform 44 (FIG. 7 position) and the platform moved away from the charge 12 back to its initial or starting position. The wrapped charge 12 is then removed from the table 14 and a new one moved into position to be wrapped.

Having described the invention, modifications will be evident to those skilled in the art without departing from the spirit of the invention as defined in the appended claims.

I claim:

1. A method of wrapping a charge with a synthetic film comprising holding an end of a film in a clamp mounted on a moveable platform, providing an anvil, a sealing means and a cut-off means on said moveable platform, raising said anvil to a raised position relative to said platform positioning said anvil against said charge by moving said platform adjacent said charge to simultaneously move said clamp, said sealing means and said cut off means into position adjacent said charge, commencing wrapping of said film around said charge by relatively rotating said charge and a source of said film, releasing a first jaw of said clamp to free said film when said film is retained on said charge, retracting a cooperating jaw of said clamp to a retracted position clear of the path of said film while completing the wrapping of said charge with said film, wrapping a first lap of film over said anvil, moving said cooperating jaw to its initial position in overlying position to said first lap while wrapping a last lap around said charge and over said anvil and said cooperating jaw, moving said first jaw into clamping position relative to said cooperating jaw and securing said first lap to said last lap over said anvil, cutting said last lap between said anvil and said clamp and moving said anvil to a lowered position clear of said film.

2. A method as defined in claim 1 wherein said first jaw is moved into clamping position before said two laps are secured together.

3. A method as defined in claim 1 wherein said two laps are secured together by moving a heat sealing platen into cooperating relationship with said anvil to heat seal said two laps of film together between said platen and said anvil.

4. A method as defined in claim 1 further comprising severing said film between said clamp and said seal before said anvil is moved to lowered position.

5. A method as defined in claim 1 wherein said laps are secured together by heat sealing.

6. A method as defined in claim 5 wherein said film is held between said first and said cooperating jaws when said heat seal is effected.

7. A method as defined in claim 6 wherein said heat seal is effected by moving a platen into heat sealing relation to said anvil to heat seal said laps together between said platen at said anvil.

8. An apparatus for wrapping a charge with a film comprising a turntable for supporting said charge, a source of film, a platform mounted on said turntable for substantially horizontal movement toward and away from said charge, means for moving said platform relative to said table, an anvil mounted on said platform for substantially vertical movement between a lower inoperative position and an elevated active position, a securing means mounted on said platform, means for moving said securing means to a position to cooperate with said anvil when said anvil is in elevated position to seal overlying layers of said film overlying said anvil, a clamp mounted on said platform, said clamp including a pair of jaws, means to independently move each of said jaws between a clamping position and a non-clamping position clear of the path of said film, cut off means mounted on said platform in position to sever said film between said clamp and said anvil.

9. An apparatus as defined in claim 8 wherein said cut off means is mounted on one of said jaws of said clamp.

10. An apparatus as defined in claim 8 wherein said securing means comprises a heat sealing platen moveable into heat sealing position with respect to said anvil to heat seal said film between said anvil and said platen and to an inoperative position clear of the path of said film.

* * * * *